US010040513B2

(12) United States Patent
Blosseville et al.

(10) Patent No.: US 10,040,513 B2
(45) Date of Patent: Aug. 7, 2018

(54) PERSONAL WATERCRAFT COMPRISING A FRONT FLOAT PROVIDED WITH A PROPULSION MEANS

(71) Applicants: Arnaud Blosseville, Yvetot Bocage (FR); Rémi Laval-Jeantet, Saint Brice sous Forêt (FR)

(72) Inventors: Arnaud Blosseville, Yvetot Bocage (FR); Rémi Laval-Jeantet, Saint Brice sous Forêt (FR)

( * ) Notice: Subject to any disclaimer, the term of this patent is extended or adjusted under 35 U.S.C. 154(b) by 0 days.

(21) Appl. No.: 15/512,270

(22) PCT Filed: Sep. 17, 2015

(86) PCT No.: PCT/EP2015/071301
§ 371 (c)(1),
(2) Date: Mar. 17, 2017

(87) PCT Pub. No.: WO2016/042065
PCT Pub. Date: Mar. 24, 2016

(65) Prior Publication Data

US 2017/0283008 A1 Oct. 5, 2017

(30) Foreign Application Priority Data

Sep. 18, 2014 (FR) ..... 14 58803

(51) Int. Cl.
*B63B 1/14* (2006.01)
*B63B 1/10* (2006.01)
*B63B 35/73* (2006.01)

(52) U.S. Cl.
CPC ..... *B63B 1/105* (2013.01); *B63B 1/14* (2013.01); *B63B 35/731* (2013.01)

(58) Field of Classification Search
CPC ..... B63B 1/14; B63B 1/105; B63B 35/731
See application file for complete search history.

(56) References Cited

U.S. PATENT DOCUMENTS 3,395,664 A * 8/1968 Greenberg ..... B62B 15/001 114/39.27
3,691,976 A * 9/1972 Wilson ..... B63B 1/125 114/39.27

(Continued)

FOREIGN PATENT DOCUMENTS

WO WO 2004/065202 8/2004
WO WO 2004065202 A1 * 8/2004 ..... B63B 1/14

OTHER PUBLICATIONS

International Search Report for PCT/EP2015/071301, dated Oct. 7, 2015, 9 pages.

*Primary Examiner* — S. Joseph Morano
*Assistant Examiner* — Jovon Hayes
(74) *Attorney, Agent, or Firm* — Nixon & Vanderhye, PC

(57) ABSTRACT

The invention relates to a personal watercraft (100) having a longitudinal axis (X) and comprising:
- a chassis (102),
- two rear floats (106) mounted at the rear of the chassis (102) on either side of a symmetry plane of the personal watercraft (100),
- a foil (116) mounted between the rear floats (106);
- a movable assembly (150) comprising:
- a suspension arm (108) that extends in front of the chassis (102), one of the ends of which is mounted so as to be able to rotate on the chassis (102) about a first rotation axis (10),
- a front float (104) mounted at the other end of said suspension arm (108), and
- a propulsion means (112) housed in the front float (104),
- the personal watercraft (100) further comprising a suspension system (114) disposed between the chassis (102) and the movable assembly (150).

9 Claims, 5 Drawing Sheets

(56) References Cited

U.S. PATENT DOCUMENTS

Figure 1:
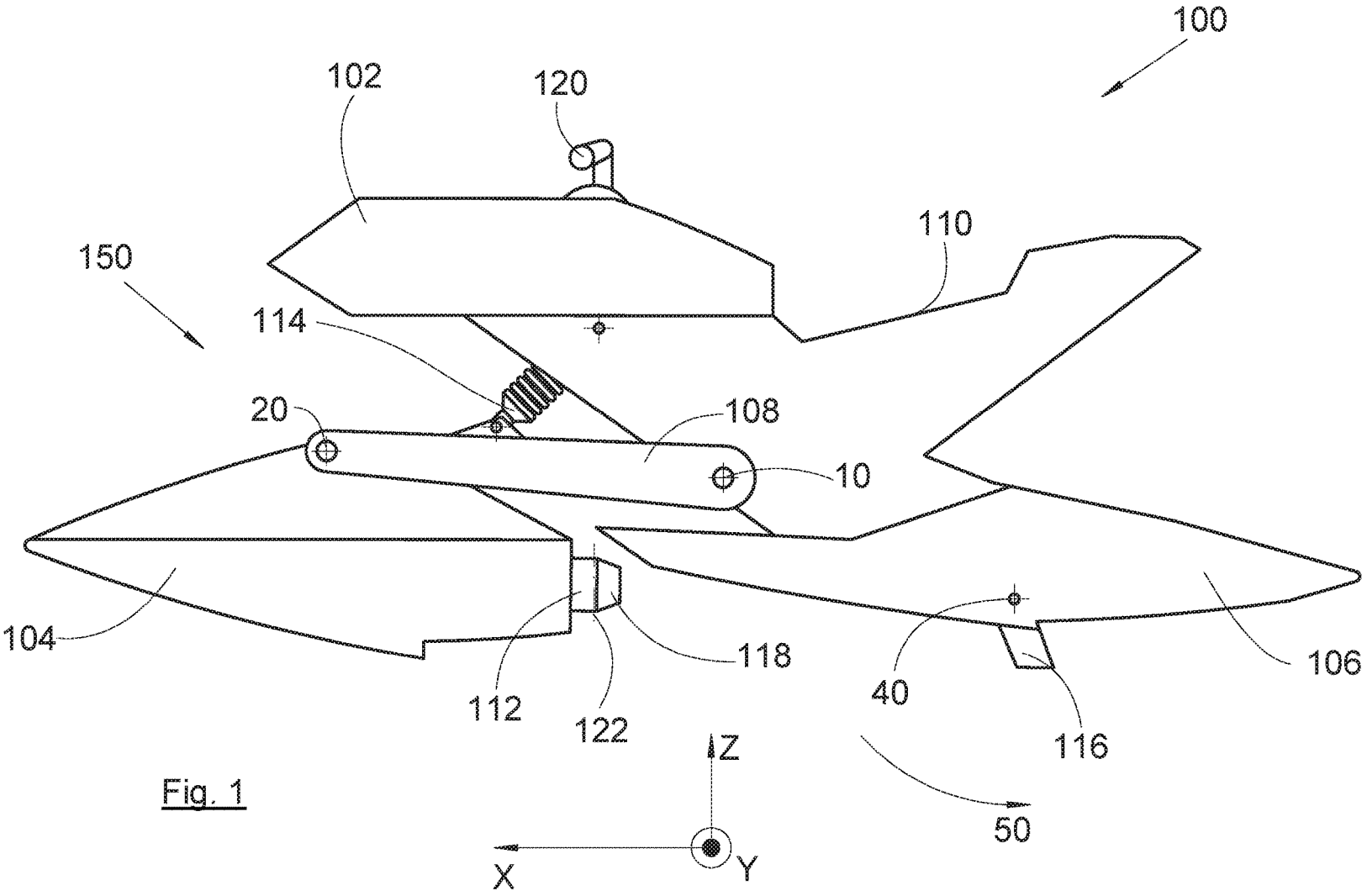

| | | | | | |
|---|---|---|---|---|---|
| 4,316,424 | A * | 2/1982 | McKenna | A63C 3/00 | 114/39.27 |
| 4,326,475 | A * | 4/1982 | Berte | B63B 1/14 | 114/39.27 |
| 4,524,709 | A * | 6/1985 | McKenna | B63B 1/125 | 114/39.27 |
| 4,757,777 | A * | 7/1988 | Rosenberger | B63B 1/125 | 114/102.32 |
| 4,777,897 | A * | 10/1988 | McKenna | B63B 1/14 | 114/218 |
| 5,894,807 | A * | 4/1999 | Aiken | B63B 1/14 | 114/102.18 |
| 5,957,071 | A * | 9/1999 | Brock | B63B 1/10 | 114/39.11 |
| 6,959,659 | B1 * | 11/2005 | Burrell | B63B 1/125 | 114/39.27 |
| 8,695,520 | B1 * | 4/2014 | Berte' | B63H 9/06 | 114/39.27 |
| 9,663,189 | B2 * | 5/2017 | Mitrovich | B63B 1/125 | |
| 2017/0283008 | A1 * | 10/2017 | Blosseville | B63B 1/105 | |

* cited by examiner

PERSONAL WATERCRAFT COMPRISING A FRONT FLOAT PROVIDED WITH A PROPULSION MEANS

This application is the U.S. national phase of International Application No. PCT/EP2015/071301 filed 17 Sep. 2015, which designated the U.S. and claims priority to FR Patent Application No. 14/58803 filed 18 Sep. 2014, the entire contents of each of which are hereby incorporated by reference.

The present invention relates to a personal watercraft comprising a front float provided with a propulsion means.

Currently, personal watercraft comprise a hull serving as a float inside which an engine actuates a turbine that discharges water in order to propel said personal watercraft.

In the water, such personal watercraft are heavy and consume a large quantity of fuel.

The document WO-A-2004/065202 discloses a personal watercraft that has two rear floats, one front float and a chassis consisting of bars. The personal watercraft also has an arm that is connected to the front float. The personal watercraft also has a device bearing the reference 54 that makes it possible solely to raise or lower a part of the chassis.

One object of the present invention is to propose a personal watercraft that does not have the drawbacks of the prior art and in particular has reduced fuel consumption and is easier to handle.

To this end, a personal watercraft is proposed having a longitudinal axis and comprising:

- a chassis,
- two rear floats mounted at the rear of the chassis on either side of a symmetry plane of the personal watercraft,
- a foil mounted between the rear floats;
- a movable assembly comprising:
- a suspension arm that extends in front of the chassis, one of the ends of which is mounted so as to be able to rotate on the chassis about a first rotation axis,
- a front float mounted at the other end of said suspension arm, and
- a propulsion means housed in the front float, the personal watercraft further comprising a suspension system disposed between the chassis and the movable assembly.

Unlike the personal watercraft of the document of the prior art cited above, in which the device for adjusting for height does not constitute a suspension, the suspension system integrated in the personal watercraft according to the invention affords better handleability.

According to a particular embodiment, the front float is mounted so as to be able to rotate on the suspension arm about a first front rotation axis parallel to the first rotation axis by means of a semi-rigid connection.

According to a particular embodiment, the suspension arm takes the form of a clevis with two bars between which the front float is positioned, the front float is mounted so as to be able to rotate on each bar about a second front rotation axis parallel to the first rotation axis, and the front float has, with each bar and in front of each second front rotation axis, an elastic connection.

Advantageously, the suspension system is disposed between the chassis and the suspension arm.

Advantageously, the suspension system is disposed between the chassis and the front float.

Advantageously, the suspension system comprises two suspensions, one of the ends of the first suspension is mounted so as to be able to rotate on the chassis about a rotation axis parallel to the first rotation axis, and the other end is mounted so as to be able to rotate on the front float about the first front rotation axis, and one of the ends of the second suspension is mounted so as to be able to rotate on the chassis about a rotation axis parallel to the first rotation axis, and the other end is mounted so as to be able to rotate on the front float about a rotation axis parallel to the first rotation axis and the second suspension is parallel to the first suspension.

Advantageously, the foil is mounted so as to be able to rotate about a retraction axis parallel to the first rotation axis.

Advantageously, the rear floats are mounted on the chassis by means of a pivot connection about a tilt axis substantially parallel to the longitudinal axis.

Advantageously, the foil is mounted so as to be able to rotate about a vertical rotation axis.

Figure 2:
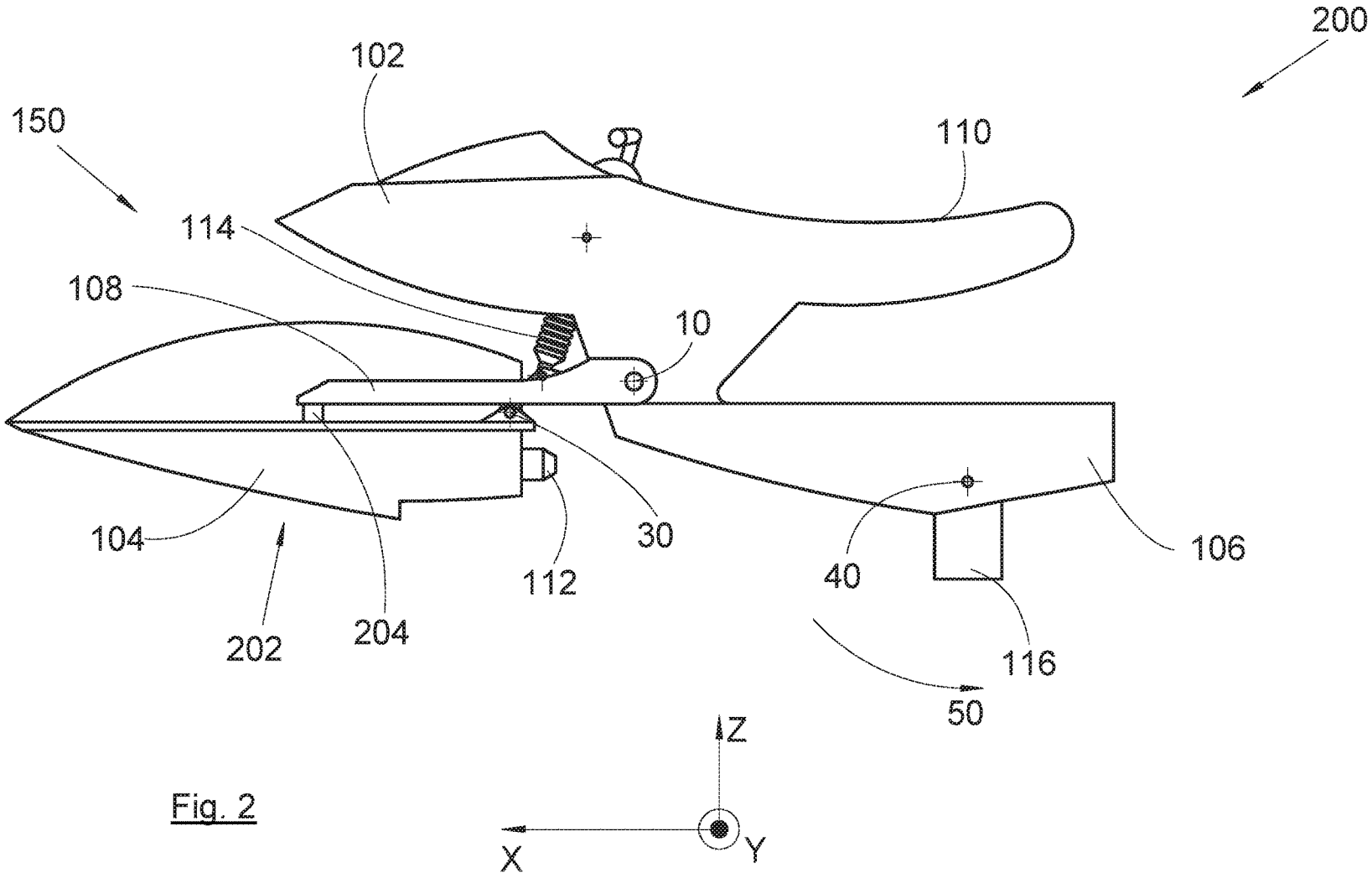
Figure 3:
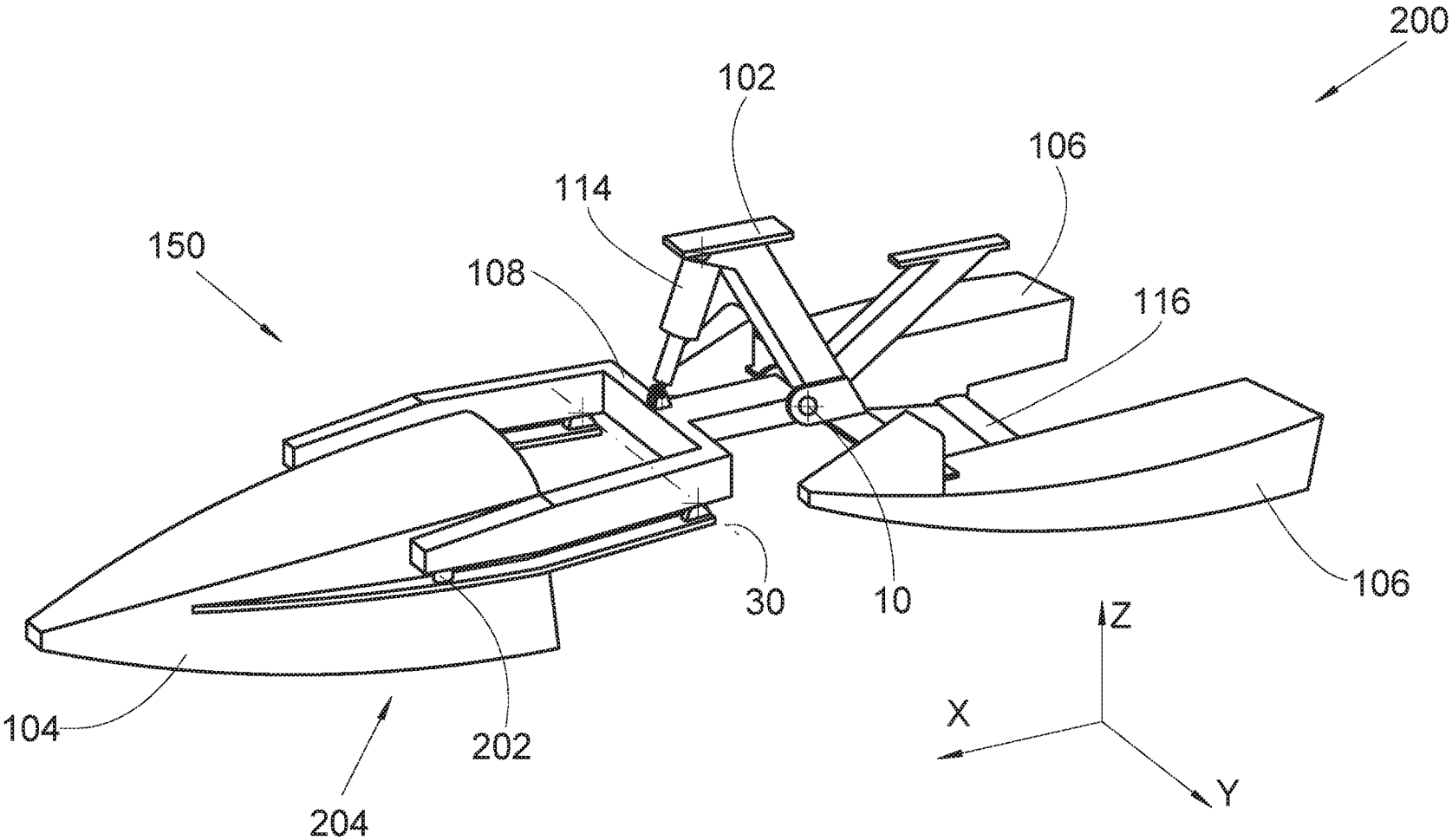
Figure 4:
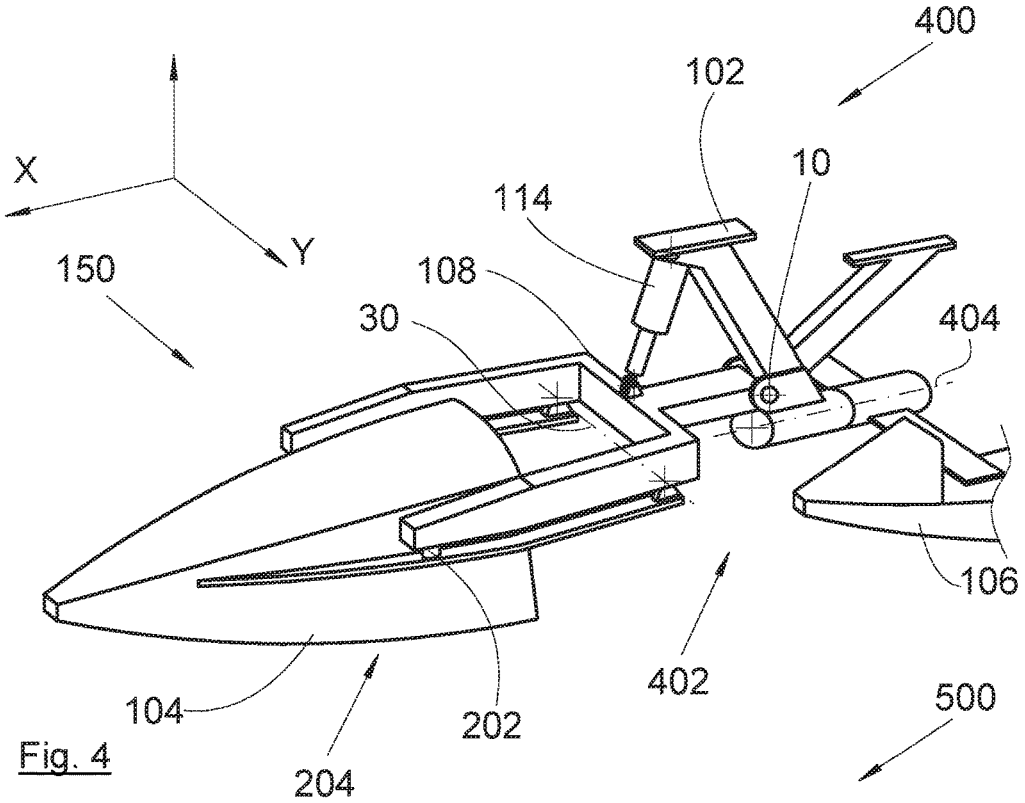
Figure 5:
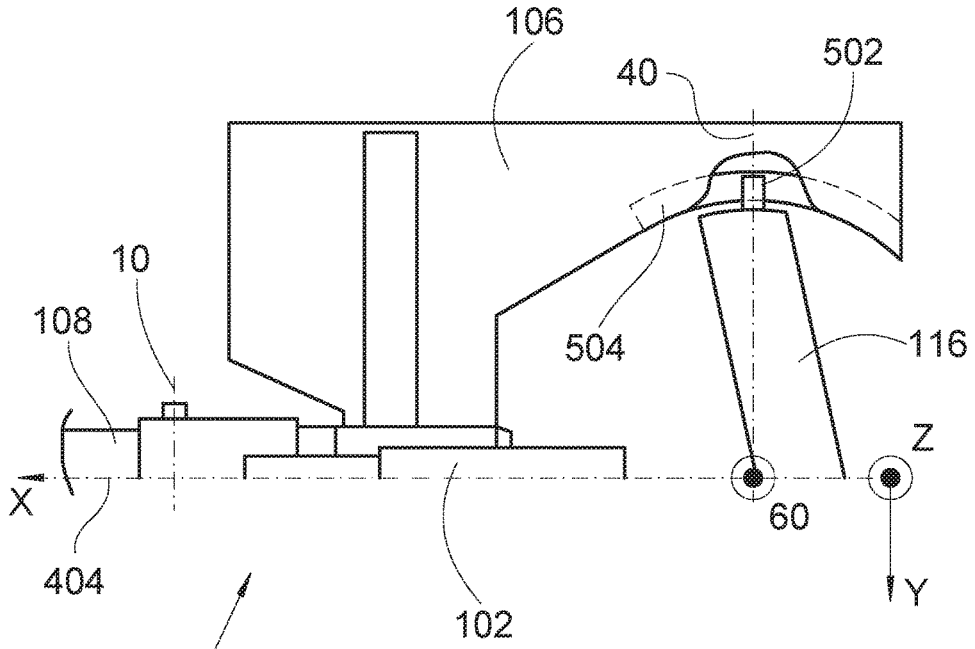
Figure 6:
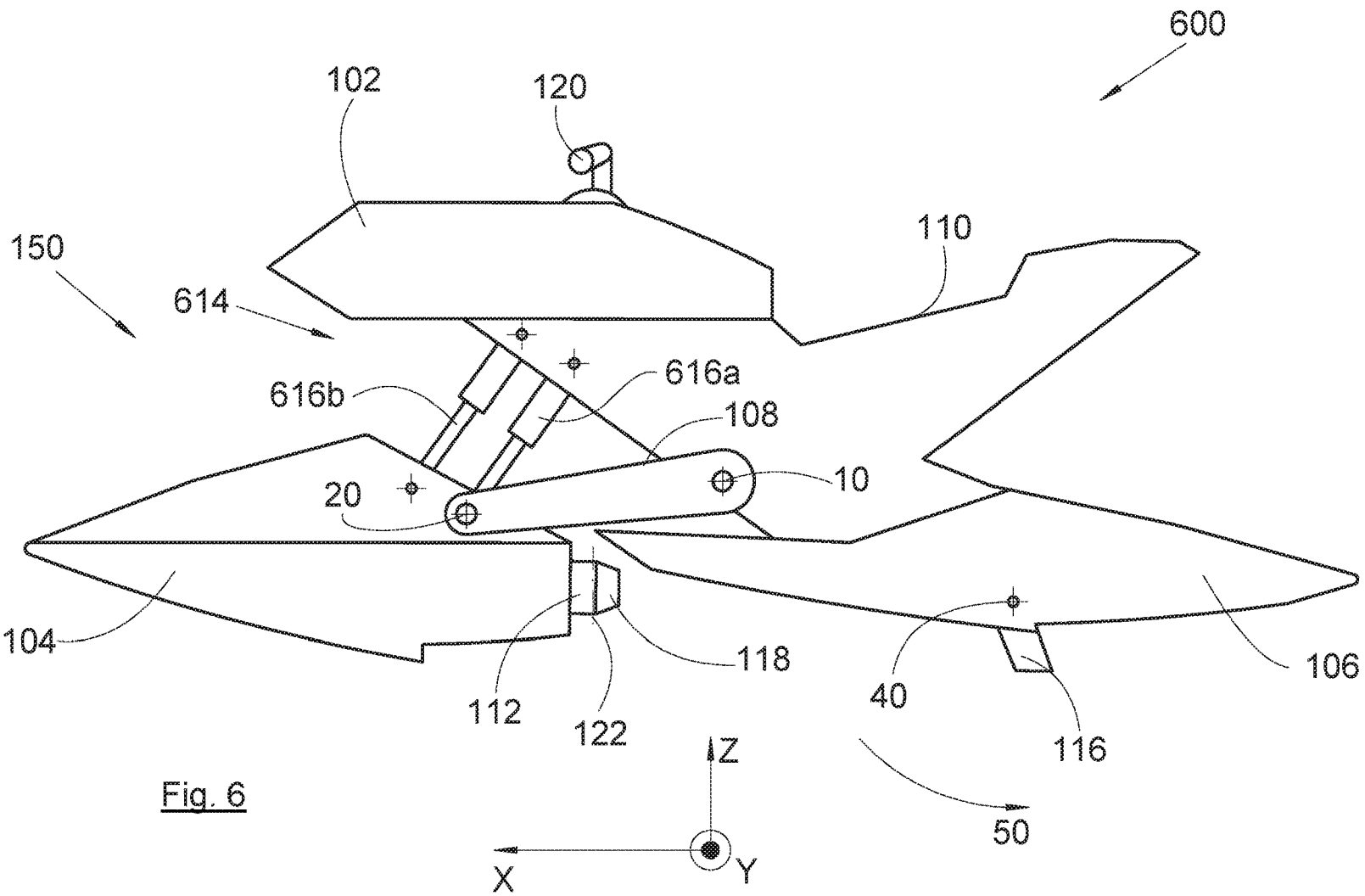

The features of the invention mentioned above, as well as others, will emerge more clearly from a reading of the following description of an example embodiment, said description being given in relation to the accompanying drawings, among which:

FIG. 1 is a side view of a personal watercraft according to a first embodiment of the invention, FIG. 2 is a side view of a personal watercraft according to a second embodiment of the invention, FIG. 3 is a perspective view of the personal watercraft of FIG. 2 without a seat, FIG. 4 is a perspective view of a personal watercraft according to a third embodiment of the invention without a seat, FIG. 5 is a plan view of a personal watercraft according to a fourth embodiment of the invention, and FIG. 6 is a side view of a personal watercraft according to a fourth embodiment of the invention.

In the following description, the terms relating to a position are taken with reference to a personal watercraft at rest, that is to say as shown in FIGS. 1 to 5, where the personal watercraft has a longitudinal axis X oriented in the direction of travel and which is here substantially horizontal. The personal watercraft is symmetrical with respect to a vertical symmetry plane containing the longitudinal axis X. A transverse direction is oriented along a horizontal transverse axis Y perpendicular to the symmetry plane and to the longitudinal axis X. A vertical direction is oriented on a vertical axis Z vertical in the symmetry plane and perpendicular to the longitudinal X and transverse Y axes.

FIG. 1 shows a personal watercraft 100 according to a first embodiment of the invention, FIG. 2 and FIG. 3 show a personal watercraft 200 according to a second embodiment of the invention, FIG. 4 shows a personal watercraft 400 according to a third embodiment of the invention, FIG. 5 shows a personal watercraft 500 according to a fourth embodiment of the invention, and FIG. 6 shows a personal watercraft 600 according to a fifth embodiment of the invention.

The personal watercraft 100, 200, 400, 500, 600 comprises:

- a chassis 102 intended to carry at least one passenger,
- two rear floats 106 mounted at the rear of the chassis 102 on either side of the symmetry plane, and
- a foil 116 mounted between the rear floats 106.

The personal watercraft 100, 200, 400, 500, 600 also comprises a movable assembly 150 comprising:

- a suspension arm 108 that extends in front of the chassis 102, one of the ends of which is mounted so as to be able to rotate on the chassis 102 about a first rotation axis 10 parallel to the transverse axis Y, a front float 104 mounted at the other end of said suspension arm 108, and a propulsion means 112 housed in the front float 104.

The personal watercraft 100, 200, 400, 500, 600 also comprises a suspension system 114, 614 disposed between the chassis 102 and the movable assembly 150.

In the embodiment of the invention presented here, the chassis 102 has a body fitted, that is to say the structural part of the chassis is covered with bodywork.

Such a personal watercraft 100, 200, 400, 500, 600 affords a significant reduction in fuel consumption because the personal watercraft 100, 200, 400, 500, 600 is extracted from the water by virtue of the foil 116 and because of this an engine less powerful than those of the personal watercraft of the prior art can be installed. Furthermore, the comfort of the passenger is improved because of the lift effect of the foil situated at the rear combined with the filtration, levelling and damping of the shocks due to waves at the front.

The chassis preferably has a seat 110 to enable the passenger to sit down.

The propulsion means 112 is preferably an engine associated with a water turbine.

In the embodiments in FIGS. 1 to 5, the suspension system 114 is disposed between the chassis 102 and the suspension arm 108.

In the embodiment in FIG. 6, the suspension system 114 is disposed between the chassis 102 and the front float 104.

In the embodiments in FIGS. 1 to 5, the suspension system 114 takes the form of a suspension that is here in the form of a telescopic tube encased in a spring. One of the ends of the suspension 114, here of the tube, is mounted so as to be able to rotate on the chassis 102 about a rotation axis parallel to the first rotation axis 10, the other end of the suspension 114, here of the tube, is mounted so as to be able to rotate on the suspension arm 108 about a rotation axis parallel to the first rotation axis 10.

In the embodiment in FIG. 1 and in the embodiment in FIG. 6, the front float 104 is mounted so as to be able to rotate on the suspension arm 108 about a first front rotation axis 20 parallel to the first rotation axis 10. The connection is a semi-rigid connection of the elastic coupling type, that is to say the connection allows a limited angular movement, for example around 30° on either side about the first front rotation axis 20.

In the embodiment in FIGS. 2, 3 and 4, the suspension arm 108 takes the form of a fork taking the form of a clevis with two bars between which the front float 104 is positioned. The front float 104 is mounted so as to be able to rotate on each bar about a second front rotation axis 30 parallel to the first rotation axis 10 and has, with each bar and in front of each second front rotation axis 30, an elastic connection 202.

Each elastic connection 202 is implemented for example by a damping element 204 of the "Silentbloc" © type.

The foil 116 is mounted, on the rear floats 106, so as to be able to rotate about a retraction axis 40 parallel to the first rotation axis 10, and thus, in the event of impact at the front of the foil 116, the latter can pivot about the retraction axis 40 in order to retract (arrow 50) towards the rear between the rear floats 106. The rotation of the foil 116 must not be flexible in order to prevent the foil 116 retracting under the effect of the movement of the personal watercraft 100 and must not be too rigid so as to prevent the foil 116 remaining locked when there is an impact.

The change in direction of the personal watercraft 100, 200, 400, 500, 600 can be effected by a change in orientation of the flow of water emerging from the propulsion means 102. For this purpose, the propulsion means 112 has a nozzle 118 able to move about a substantially vertical rotation axis 122, and the personal watercraft 100 has an orientable lever 120 and an orientation system that controls the orientation of the nozzle 118 according to the position of the lever 120. The orientation system may be a cable system.

An action of the lever 120 for turning to the left causes a rotation of the nozzle 118 to the right and the flow of water is then directed towards the outside of the turn. Conversely, an action of the lever 120 to turn to the right causes a rotation of the nozzle 118 to the left and the flow of water is then directed towards the outside of the turn.

In place of the nozzle 118, it is also possible to install one or more deflector flaps.

In the embodiment in FIG. 4, the rear floats 116 are mounted on the chassis 102 by means of a pivot connection 402 about a tilt axis 404 substantially parallel to the longitudinal axis X. This configuration also allows the change of direction of the personal watercraft 400.

In the embodiment of the invention presented in FIG. 4, the pivot connection 402 is implemented by two coaxial cylinders mounted so as to be able to rotate with respect to each other about the tilt axis 404, one of which is secured to the chassis 102 and the other of which is secured to the rear floats 106.

In the embodiment of the invention in FIG. 5, the foil 116 is mounted so as to be able to rotate about a vertical rotation axis 60 parallel to the vertical axis Z. The movement of the foil 116 about the axis 60 can be controlled by the lever 120 or by foot controls. The movement of the foil 116 causes the change in direction of the personal watercraft 500. Control of the foil 116 can be achieved by any appropriate means, such as for example a cable system.

In the embodiment of the system presented here, the foil 116 is extended on either side by a stud 502. Each stud 502 slides in a groove 504 produced in the associated rear float 116, which enables the foil 116 to pivot.

The stud 502 also allows a rotation of the foil 116 about the retraction axis 40.

Just one of the systems described above allowing a change of direction of the watercraft 100, 200, 400, 500, 600 may be implemented, but it is also possible to simultaneously implement a plurality of them. As in the case of FIG. 5 where the floats 106 are able to move about the tilt axis 404 and where the foil 116 is able to move about the vertical rotation axis 60.

The suspension system 614 of the personal watercraft 600 may take the form of a single suspension disposed between the chassis 102 and the front float 104.

However, in the embodiment in FIG. 6, the suspension system 614 comprises two suspensions 616*a*-*b*, each here taking the form of a telescopic tube encased in a spring. Such an arrangement makes it possible to cope with heavy conditions of use by absorbing greater impacts.

One of the ends of the first suspension 616*a* is mounted so as to be able to rotate on the chassis 102 about a rotation axis parallel to the first rotation axis 10, and the other end is mounted so as to be able to rotate on the front float 104 about a first front rotation axis 20.

One of the ends of the second suspension 616*b* is mounted so as to be able to rotate on the chassis 102 about a rotation axis parallel to the first rotation axis 10, and the other end is mounted so as to be able to rotate on the front float 104 about a rotation axis parallel to the first rotation axis 10 and the second suspension 616*b* is parallel to the first suspension 616*a*.

Naturally the present invention is not limited to the examples and embodiments described and depicted but is capable of numerous variants accessible to persons skilled in the art.

For example, the chassis is sized for one passenger, but it could be sized for two passengers or more.

The invention claimed is:

1. Personal watercraft having a longitudinal axis (X) and comprising:

a chassis, two rear floats mounted at the rear of the chassis on either side of a symmetry plane of the personal watercraft, a foil mounted between the rear floats;

a movable assembly comprising:

a suspension arm that extends in front of the chassis, one of the ends of which is mounted so as to be able to rotate on the chassis about a first rotation axis, a front float mounted at the other end of said suspension arm, and a propulsion means housed in the front float, the personal watercraft further comprising a suspension system disposed between the chassis and the movable assembly.

2. Personal watercraft according to claim 1, wherein the front float is mounted so as to be able to rotate on the suspension arm about a first front rotation axis parallel to the first rotation axis by means of a semi-rigid connection.

3. Personal watercraft according to claim 1, wherein the suspension arm takes the form of a clevis with two bars between which the front float is positioned, wherein the front float is mounted so as to be able to rotate on each bar about a second front rotation axis parallel to the first rotation axis and wherein the front float has, with each bar and in front of each second front rotation axis, an elastic connection.

4. Personal watercraft according to claim 1, wherein the suspension system is disposed between the chassis and the suspension arm.

5. Personal watercraft according to claim 1, wherein the suspension system is disposed between the chassis and the front float.

6. Personal watercraft according to claim 5, wherein the suspension system comprises two suspensions, wherein one of the ends of the first suspension is mounted so as to be able to rotate on the chassis about a rotation axis parallel to the first rotation axis, and the other end is mounted so as to be able to rotate on the front float about the first front rotation axis, and wherein one of the ends of the second suspension is mounted so as to be able to rotate on the chassis about a rotation axis parallel to the first rotation axis, and the other end is mounted so as to be able to rotate on the front float about a rotation axis parallel to the first rotation axis and the second suspension is parallel to the first suspension.

7. Personal watercraft according to claim 1, wherein the foil is mounted so as to be able to rotate about a retraction axis parallel to the first rotation axis.

8. Personal watercraft according to claim 1, wherein the rear floats are mounted on the chassis by means of a pivot connection about a tilt axis substantially parallel to the longitudinal axis (X).

9. Personal watercraft according to claim 1, wherein the foil is mounted so as to be able to rotate about a vertical rotation axis.

* * * * *